US011442407B2

(12) United States Patent
Okamoto

(10) Patent No.: US 11,442,407 B2
(45) Date of Patent: Sep. 13, 2022

(54) COOLING DEVICE, FIXING DEVICE, AND IMAGE FORMING APPARATUS

(71) Applicant: Jun Okamoto, Tokyo (JP)

(72) Inventor: Jun Okamoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/324,510

(22) Filed: May 19, 2021

(65) Prior Publication Data

US 2021/0364986 A1 Nov. 25, 2021

(30) Foreign Application Priority Data

May 22, 2020 (JP) ..... JP2020-089587
Sep. 14, 2020 (JP) ..... JP2020-153930

(51) Int. Cl.
*G03G 15/20* (2006.01)
*G03G 21/20* (2006.01)

(52) U.S. Cl.
CPC ..... *G03G 21/206* (2013.01); *G03G 15/2017* (2013.01); *G03G 15/2021* (2013.01); *G03G 15/2039* (2013.01); *G03G 15/2042* (2013.01); *G03G 2221/1645* (2013.01)

(58) Field of Classification Search
CPC ..... G03G 21/206; G03G 15/2021; G03G 15/2039; G03G 15/2042; G03G 15/2046; G03G 15/2017; G03G 15/2064; G03G 2221/1645
See application file for complete search history.

(56) References Cited

U.S. PATENT DOCUMENTS 5,787,321 A * 7/1998 Nishikawa ..... G03G 15/2042 165/205
10,606,195 B2 * 3/2020 Nakajima ..... G03G 15/2028
2010/0232826 A1 * 9/2010 Takatsu ..... G03G 15/6573 399/92
2011/0052245 A1 * 3/2011 Shinshi ..... G03G 15/2025 399/92
2012/0237274 A1 9/2012 Okamoto
2013/0142551 A1 6/2013 Yamano et al.
2013/0236202 A1 * 9/2013 Akiya ..... G03G 15/2017 399/69
2014/0112680 A1 4/2014 Ueno et al.
2014/0119762 A1 5/2014 Suzuki et al.
(Continued)

FOREIGN PATENT DOCUMENTS

JP 10-198219 7/1998
JP 2007145481 A * 6/2007
(Continued)

*Primary Examiner* — Walter L Lindsay, Jr.
*Assistant Examiner* — Laura Roth
(74) *Attorney, Agent, or Firm* — Harness, Dickey & Pierce, P.L.C.

(57) ABSTRACT

A cooling device cools, with air, a heating member having a longitudinal direction. The cooling device includes a blower, an air duct, and an air-volume varying mechanism. The blower blows the air. The air passes through the air duct. The air duct has a first opening to which the air is supplied by the blower, a second opening to face a portion of the heating member, and a third opening to face another portion of the heating member. The air-volume varying mechanism changes an air volume of the air discharged from the second opening and the third opening.

11 Claims, 15 Drawing Sheets

(56) References Cited

U.S. PATENT DOCUMENTS

| | | | | |
|---|---|---|---|---|
| 2015/0063846 | A1* | 3/2015 | Fukai | G03G 15/2028 399/45 |
| 2016/0349677 | A1 | 12/2016 | Okamoto | |
| 2017/0176899 | A1 | 6/2017 | Okamoto et al. | |
| 2017/0343942 | A1 | 11/2017 | Okamoto et al. | |
| 2018/0203384 | A1 | 7/2018 | Okamoto et al. | |
| 2019/0049880 | A1* | 2/2019 | Hagiwara | G03G 21/20 |
| 2020/0241452 | A1 | 7/2020 | Saitoh et al. | |
| 2020/0241453 | A1 | 7/2020 | Okamoto et al. | |

FOREIGN PATENT DOCUMENTS

| | | |
|---|---|---|
| JP | 2013-068772 | 4/2013 |
| JP | 2013-186417 | 9/2013 |
| JP | 2016-109977 | 6/2016 |

* cited by examiner

COOLING DEVICE, FIXING DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2020-089587, filed on May 22, 2020, and 2020-153930, filed on Sep. 14, 2020, in the Japan Patent Office, the entire disclosure of each of which is hereby incorporated by reference herein.

BACKGROUND

Technical Field

Embodiments of the present disclosure relate to a cooling device, a fixing device, and an image forming apparatus, and more particularly to a cooling device that cools a heating member having a longitudinal direction, and a fixing device and an image forming apparatus including the cooling device.

Related Art

Various types of fixing devices used in an electrophotographic image forming apparatus are known, and one of the types is a surf fixing system that is excellent in energy saving performance and short in warm-up time. In the surf fixing method, a thin fixing belt having a low heat capacity is contact-heated from the inside by a planar heater, a sheet passing through a fixing nip is heated by the fixing belt, and an unfixed toner image borne on the sheet is fixed under heat.

When small-size sheets are continuously printed by such a fixing device, the temperatures of the longitudinal end portions (non-sheet passing portions) of the fixing belt may rise. With the rise in the temperatures of the end portions, when the printing of the small-sized sheet is shifted to the printing of the large-sized sheet, the supply amount of fixing heat at the end portions becomes excessive (high temperature). Problems such as an offset and a jam due to sheet winding around the fixing belt may occur. As a countermeasure for restraining the temperature rise at the end portions, for example, a cooling device is known in which blower fans are disposed at both end portions of a fixing belt, respectively, and air blowing ports of the blower fans are partially covered with shutters according to a sheet size.

SUMMARY

According to an aspect of the present disclosure, there is provided a cooling device that cools, with air, a heating member having a longitudinal direction. The cooling device includes a blower, an air duct, and an air-volume varying mechanism. The blower blow the air. The air passes through the air duct. The air duct has a first opening to which the air is supplied by the blower, a second opening to face a portion of the heating member, and a third opening to face another portion of the heating member. The air-volume varying mechanism changes an air volume of the air discharged from the second opening and the third opening.

According to another aspect of the present disclosure, there is provided a cooling device that cools, with air, a heating member having a longitudinal direction. The cooling device includes a blower and an air duct. The blower blows the air. The air passes through the air duct. The air duct has a first opening to which the air is supplied by the blower, a second opening configured to face a portion of the heating member, and a third opening configured to face another portion of the heating member.

According to another aspect of the present disclosure, there is provided an image forming apparatus that includes a fixing device, a cooling device, and a controller. The fixing device includes a heating member configured to heat and fix a toner image borne on a sheet. The cooling device cools the fixing device with air. The controller controls the cooling device to cool the fixing device with the air. The cooling device includes a blower, an air duct, an air-volume varying mechanism, and another air-volume varying mechanism. The blower blows the air. The air passes through the air duct. The air duct has a first opening to which the air is supplied by the blower, a second opening configured to face a portion of the heating member, and a third opening configured to face another portion of the heating member. The air-volume varying mechanism changes an air volume ratio of the air discharged from the second opening and the third opening. The other air-volume varying mechanism varies an air blowing amount of the blower.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1A:
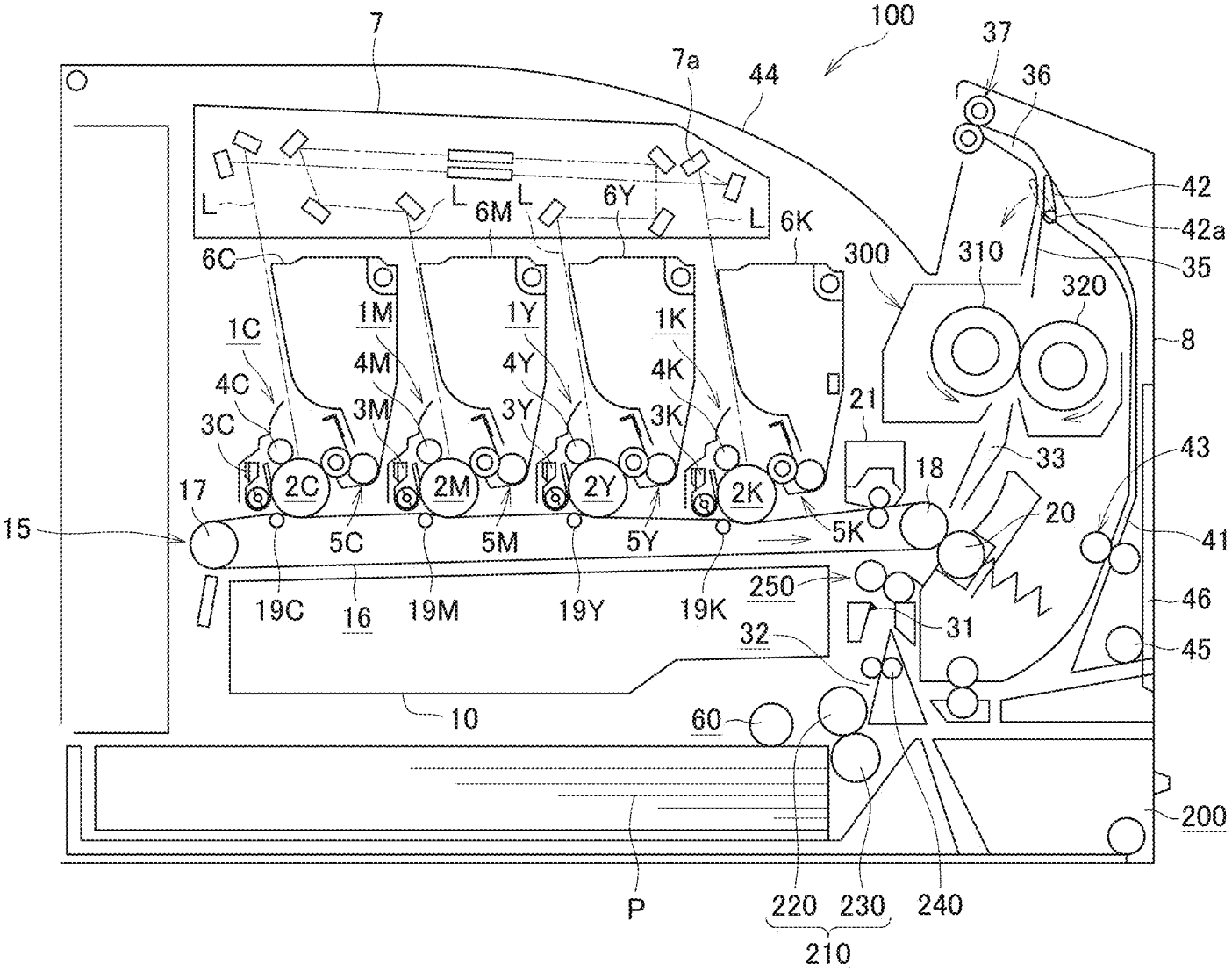
FIG. 1A is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

Hereinafter, a cooling device according to an embodiment of the present disclosure, and a fixing device and an image forming apparatus (illustrated as a laser printer) using the cooling device are described with reference to drawings. The laser printer is just an example of the image forming apparatus, and thus the image forming apparatus is not limited to the laser printer. In other words, the image forming apparatus may be a copier, a facsimile machine, a printer, a plotter, an inkjet recording apparatus, or a multifunction peripheral having at least two of copying, printing, facsimile transmission, plotting, scanning, and inkjet recording capabilities.

Note that identical or similar reference characters are given to identical or corresponding parts throughout drawings, and redundant descriptions may be omitted or simplified below. Further, size (dimension), material, shape, and relative positions used to describe each of the components and units are examples, and the scope of the present disclosure is not limited thereto unless otherwise specified.

Although a "recording medium" is described as a "sheet of paper" (simply referred to as "sheet") in the following embodiments, the "recording medium" is not limited to the sheet of paper. Examples of the "recording medium" include not only the sheet of paper but also an overhead projector (OHP) transparency sheet, a fabric, a metallic sheet, a plastic film, and a prepreg sheet including carbon fibers previously impregnated with resin.

Examples of the "recording medium" include all media to which developer or ink can be adhered, and so-called recording paper and recording sheets. Examples of the "sheet" include thick paper, a postcard, an envelope, thin paper, coated paper (e.g., coat paper and art paper), and tracing paper, in addition to plain paper.

The term "image formation" used in the following description means not only giving an image such as a character or a figure to a medium but also giving an arbitrary image such as a pattern to the medium.

Figure 1B:
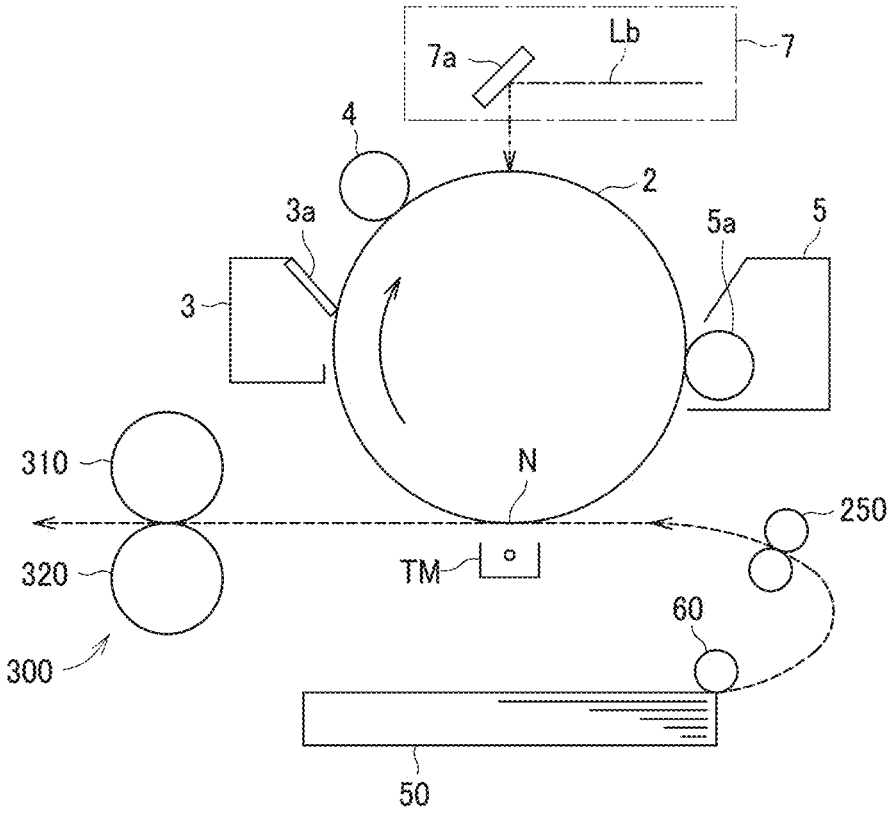
FIG. 1B is a schematic diagram illustrating the principle of how an image forming apparatus operates, according to an embodiment of the present disclosure.

Configuration of Image Forming Apparatus FIG. 1A is a schematic diagram illustrating a configuration of an image forming apparatus 100 (illustrated as a laser printer) including a fixing device 300 or a cooling device according to an embodiment of the present disclosure. FIG. 1B illustrates the principle of an operation in the laser printer (as the image forming apparatus according to the present embodiment).

The image forming apparatus 100 includes four process units 1K, 1Y, 1M, and 1C as image forming devices. Suffixes, which are K, Y, M, and C, are used to indicate respective colors of toners (black, yellow, magenta, and cyan toners in this example) for the process units. The process units 1K, 1Y, 1M, and 1C have substantially the same configuration except for containing different color toners of black (K), yellow (Y), magenta (M), and cyan (C) corresponding to color separation components of a color image.

The process units 1K, 1Y, 1M, and 1C respectively include toner bottles 6K, 6Y, 6M, and 6C containing different color toners. The process units 1K, 1Y, 1M, and 1C have a similar structure except the color of toner. Thus, the configuration of the one process unit 1K is described below, and the descriptions of the other process units 1Y, 1M, and 1C are omitted.

The process unit 1K includes an image bearer 2K such as a photoconductor drum, a photoconductor cleaner 3K, and a discharger. The process unit 1K further includes a charging device 4K as a charger that uniformly charges the surface of the image bearer and a developing device 5K as a developing unit that renders visible an electrostatic latent image formed on the image bearer. The process unit 1K is detachably attachable to a housing of the image forming apparatus 100. Consumable parts of the process unit 1K can be replaced at one time.

An exposure device 7 is disposed above the process units 1K, 1Y, 1M, and 1C in the image forming apparatus 100. The exposure device 7 performs writing and scanning based on image data, in other words, irradiates the image bearer 2K with laser light L emitted by a laser diode and reflected by mirrors 7*a* based on the image data.

A transfer device 15 is disposed below the process units 1K, 1Y, 1M, and 1C in the present embodiment. The transfer device 15 corresponds to a transfer unit TM in FIG. 1B. Primary transfer rollers 19K, 19Y, 19M, and 19C are disposed opposite the image bearers 2K, 2Y, 2M, and 2C, respectively, to contact an intermediate transfer belt 16.

The intermediate transfer belt 16 is stretched around and entrained by the primary transfer rollers 19K, 19Y, 19M, and 19C, a drive roller 18, and a driven roller 17 to rotate in a circulating manner. A secondary transfer roller 20 is disposed opposite the drive roller 18 to contact the intermediate transfer belt 16. Note that, when the image bearers 2K, 2Y, 2M, and 2C serve as primary image bearers to bear images of the respective colors, the intermediate transfer belt 16 serves as a secondary image bearer to bear a composite image in which the images on the respective image bearers 2K, 2Y, 2M, and 2C are superimposed one on another.

A belt cleaner 21 is disposed downstream from the secondary transfer roller 20 in a direction of rotation of the intermediate transfer belt 16. A cleaning backup roller is disposed opposite the belt cleaner 21 via the intermediate transfer belt 16.

A sheet feeder 200 including a tray loaded with sheets P is disposed in a lower portion of the image forming apparatus 100. The sheet feeder 200 serves as a recording-medium supply device and can store a bundle of a large number of sheets P as recording media. The sheet feeder 200 is integrated as a single unit together with a sheet feed roller 60 and a roller pair 210 as a conveyor for the sheets P.

The sheet feeder 200 is detachably inserted in the housing of the image forming apparatus 100 to supply the sheet. The sheet feed roller 60 and the roller pair 210 are disposed at an upper portion of the sheet feeder 200 and convey the uppermost one of the sheets P in the sheet feeder 200 to a sheet feeding path 32.

A registration roller pair 250 as a separation conveyor is disposed near the secondary transfer roller 20 and upstream from the secondary transfer roller 20 in a sheet conveyance direction and can temporarily stop the sheet P fed from the sheet feeder 200. Temporarily stopping the sheet P causes slack on the leading-edge side of the sheet P and corrects a skew of the sheet P.

A registration sensor 31 is disposed immediately upstream from the registration roller pair 250 in the sheet conveyance direction and detects passage of a leading edge of the sheet. When a predetermined time passes after the registration sensor 31 detects the passage of the leading edge of the sheet, the sheet contacts the registration roller pair 250 and temporarily stops.

Conveyance rollers 240 are disposed downstream from the sheet feeder 200 to convey the sheet, which has been conveyed to the right side from the roller pair 210, upward. As illustrated in FIG. 1A, the conveyance rollers 240 conveys the sheet to the registration roller pair 250 upward.

The roller pair 210 includes a pair of an upper roller and a lower roller. The roller pair 210 can adopt a friction reverse roller (feed and reverse roller (FRR)) separation system or a friction roller (FR) separation system.

In the FRR separation system, a separation roller (a return roller) is applied with a certain amount of torque in a counter sheet feeding direction from a driving shaft via a torque limiter and pressed against a feed roller to separate sheets in a nip between the separation roller and the feed roller. In the FR separation system, a separation roller (a friction roller) is supported by a secured shaft via a torque limiter and pressed against a feed roller to separate sheets in a nip between the separation roller and the feed roller.

The roller pair 210 in the present embodiment has a configuration of the FRR separation system. That is, the roller pair 210 includes a feed roller 220 and a separation roller 230. The feed roller 220 is an upper roller of the roller pair 210 and conveys a sheet toward an inner side of the image forming apparatus 100. The separation roller 230 is a lower roller of the roller pair 210. A driving force acting in a direction opposite a direction in which a driving force is given to the feed roller 220 is given to the separation roller 230 by a driving shaft through a torque limiter.

The separation roller 230 is pressed against the feed roller 220 by a pressing member such as a spring. A clutch transmits the driving force of the feed roller 220 to the sheet feed roller 60. Thus, the sheet feed roller 60 rotates left in FIG. 1A.

The registration roller pair 250 feeds the sheet P, which has contacted the registration roller pair 250 and has been slackened at the leading-edge side of the sheet P, toward a secondary transfer nip between the secondary transfer roller 20 and the drive roller 18, which is illustrated as a transfer nip N in FIG. 1B, at a suitable timing to transfer a toner image on the intermediate transfer belt 16 onto the sheet P. A bias applied at the secondary transfer nip electrostatically transfers the toner image formed on the intermediate transfer belt 16 onto the fed sheet P at a desired transfer position with high accuracy.

A post-transfer conveyance path 33 is disposed above the secondary transfer nip between the secondary transfer roller 20 and the drive roller 18. The fixing device 300 is disposed near an upper end of the post-transfer conveyance path 33.

The fixing device 300 includes a fixing belt 310 as a heating member including a heat generating member and a pressure roller 320 as a pressure member that rotates while contacting the fixing belt 310 with a predetermined pressure. The fixing device 300 can be of various types as illustrated in FIG. 2A to FIG. 2D, which will be described later. First, the fixing device 300 is described according to the type illustrated in FIG. 2A.

A post-fixing conveyance path 35 is disposed above the fixing device 300 and branches into a sheet ejection path 36 and a reverse conveyance path 41 at the upper end of the post-fixing conveyance path 35. At this branching portion, a switching member 42 is disposed and pivots on a pivot shaft 42*a*. At an opening end of the sheet ejection path 36, a pair of sheet ejection rollers 37 is disposed.

The reverse conveyance path 41 begins from the branching portion and converges into the sheet feeding path 32. Additionally, a reverse conveyance roller pair 43 is disposed midway in the reverse conveyance path 41. An upper face of the image forming apparatus 100 is recessed to an inner side of the image forming apparatus 100 and serves as an sheet ejection tray 44.

A powder container 10 such as a toner container is disposed between the transfer device 15 and the sheet feeder 200. The powder container 10 is removably installed in the housing of the image forming apparatus 100.

The image forming apparatus 100 according to the present embodiment has a predetermined distance from the sheet feed roller 60 to the secondary transfer roller 20 in consideration of the conveyance of a sheet on which a toner image is to be transferred. The powder container 10 is disposed in a dead space caused by the predetermined distance to keep the entire image forming apparatus compact.

A transfer cover 8 is disposed above the sheet feeder 200 and on a front side in a direction to which the sheet feeder 200 is pulled out. The transfer cover 8 can be opened to check an interior of the image forming apparatus 100. The transfer cover 8 includes a bypass feed roller 45 for bypass sheet feeding and a bypass feed tray 46 for the bypass sheet feeding.

Operation of Image Forming Apparatus Next, a basic operation of the image forming apparatus (illustrated as the laser printer) according to the present embodiment is described below with reference to FIG. 1A. First, operations of a simplex or single-sided printing are described.

Referring to FIG. 1A, the sheet feed roller 60 rotates according to a sheet feeding signal from a controller of the image forming apparatus 100. The sheet feed roller 60 separates the uppermost sheet from a bundle of sheets P (also referred to as sheet bundle) loaded in the sheet feeder 200 and feeds the uppermost sheet to the sheet feeding path 32.

When the leading edge of the sheet P, which has been fed by the sheet feed roller 60 and the roller pair 210, reaches a nip of the registration roller pair 250, the sheet P is slackened and temporarily stopped by the registration roller pair 250. The registration roller pair 250 corrects the skew on the leading-edge side of the sheet P and rotates in synchronization with an optimum timing so that a toner image formed on the intermediate transfer belt 16 is transferred onto the sheet P.

When the sheet P is fed from the bypass feed tray 46, sheets P of the sheet bundle loaded on the bypass feed tray 46 are fed one by one from the uppermost sheet of the sheet bundle by the bypass feed roller 45. Then, the sheet P passes a part of the reverse conveyance path 41 and is conveyed to the nip of the registration roller pair 250. The subsequent operations are the same as the sheet feeding operations from the sheet feeder 200.

As to image formation, operations of the processing unit 1K are described as representative, and descriptions of the other processing units 1Y, 1M, and 1C are omitted here. First, the charging device 4K uniformly charges the surface of the image bearer 2K to high potential. The exposure device 7 irradiates the surface of the image bearer 2K with laser light L according to image data.

The surface of the image bearer 2K irradiated with the laser light L has an electrostatic latent image due to a drop in the potential of the irradiated portion. The developing device 5K includes a developer bearer to bear a developer including toner and transfers unused black toner supplied from the toner bottle 6K onto the irradiated portion of the surface of the image bearer 2K having the electrostatic latent image, through the developer bearer.

The image bearer 2K to which the toner has been transferred forms (develops) a black toner image on the surface of the image bearer 2K. The black toner image formed on the image bearer 2K is transferred onto the intermediate transfer belt 16.

The photoconductor cleaner 3K removes residual toner remaining on the surface of the image bearer 2K after an intermediate transfer operation. The removed residual toner is conveyed by a waste toner conveyor and collected to a waste toner container in the processing unit 1K. The discharger discharges the remaining charge on the image bearer 2K from which the remaining toner is removed by the photoconductor cleaner 3K.

Similarly, toner images are formed on the image bearers 2Y, 2M, and 2C in the processing units 1Y, 1M, and 1C for the colors, and color toner images are transferred to the intermediate transfer belt 16 such that the color toner images are superimposed on one on another.

The intermediate transfer belt 16 on which the color toner images are transferred and superimposed travels such that the color toner images reach the secondary transfer nip between the secondary transfer roller 20 and the drive roller 18. The registration roller pair 250 rotates to nip the sheet P contacting the registration roller pair 250 at a predetermined timing and conveys the sheet P to the secondary transfer nip of the secondary transfer roller at a suitable timing such that a composite toner image formed by superimposing and transferring the toner images on the intermediate transfer belt 16 is transferred onto the sheet P. In this manner, the composite toner image on the intermediate transfer belt 16 is transferred to the sheet P sent out by the registration roller pair 250.

The sheet P having the transferred composite toner image is conveyed to the fixing device 300 through the post-transfer conveyance path 33. The sheet P conveyed to the fixing device 300 is nipped by the fixing belt 310 and the pressure roller 320. The unfixed toner image is fixed onto the sheet P under heat and pressure in the fixing device 300. The sheet P, on which the composite toner image has been fixed, is sent out from the fixing device 300 to the post-fixing conveyance path 35.

When the fixing device 300 sends out the sheet P, the switching member 42 is at a position at which the upper end of the post-fixing conveyance path 35 is open, as indicated by the solid line of FIG. 1A. The sheet P sent from the fixing device 300 is sent to the sheet ejection path 36 via the post-fixing conveyance path 35. The pair of sheet ejection rollers 37 nip the sheet P sent out to the sheet ejection path 36 and rotate to eject the sheet P to the sheet ejection tray 44. Thus, the single-sided printing is finished.

Next, a description is given of operations of a duplex or double-sided printing. Similarly with the single-sided printing described above, the fixing device 300 sends out the sheet P to the sheet ejection path 36. In duplex printing, each of the pair of sheet ejection rollers 37 rotates in a direction to convey a part of the sheet P outside the image forming apparatus 100.

When the trailing edge of the sheet P passes through the sheet ejection path 36, the switching member 42 pivots on the pivot shaft 42*a* as indicated with a broken line in FIG. 1A to close the upper end of the post-fixing conveyance path 35. When the upper end of the post-fixing conveyance path 35 is closed, substantially simultaneously, each of the pair of sheet ejection rollers 37 rotates in reverse (in other words, in a direction opposite to the direction to convey a part of the sheet P outside the image forming apparatus 100) to convey the sheet P to an inner side of the image forming apparatus 100, that is, to the reverse conveyance path 41.

The sheet P sent out to the reverse conveyance path 41 reaches the registration roller pair 250 via the reverse conveyance roller pair 43. The registration roller pair 250 sends out the sheet P to the secondary transfer nip at a suitable timing such that the toner image formed on the intermediate transfer belt 16 is transferred onto the other surface of the sheet P to which no toner image has been transferred.

When the sheet P passes through the secondary transfer nip, the secondary transfer roller 20 and the drive roller 18 transfer the toner image to the other surface (back side) of the sheet P to which no toner image has been transferred. The sheet P having the transferred toner image is conveyed to the fixing device 300 through the post-transfer conveyance path 33.

In the fixing device 300, the sheet P is nipped by the fixing belt 310 and the pressure roller 320, and the unfixed toner image are fixed on the back side of the sheet P under heat and pressure. The sheet P having the toner images fixed to both front and back sides of the sheet P in this manner is sent out from the fixing device 300 to the post-fixing conveyance path 35.

When the fixing device 300 sends out the sheet P, the switching member 42 is at a position at which the upper end of the post-fixing conveyance path 35 is open, as indicated by the solid line of FIG. 1A. The sheet P sent from the fixing device 300 is sent to the sheet ejection path 36 via the post-fixing conveyance path 35. The pair of sheet ejection rollers 37 nips the sheet P sent out to the sheet ejection path 36 and rotates to eject the sheet P to the sheet ejection tray 44. Thus, the duplex printing is finished.

After the toner image on the intermediate transfer belt 16 is transferred onto the sheet P, residual toner remains on the intermediate transfer belt 16. The belt cleaner 21 removes the residual toner from the intermediate transfer belt 16. The waste toner conveyor conveys the toner removed from the intermediate transfer belt 16 to the powder container 10, and the toner is collected inside the powder container 10.

Fixing Device Next, a description is given of a cooling device according to an embodiment of the present disclosure and a fixing device 300 according to some embodiments of the present disclosure. The cooling device according to the present embodiment cools both end portions of the fixing belt 310 in a longitudinal direction of the fixing device 300.

Figure 2A:
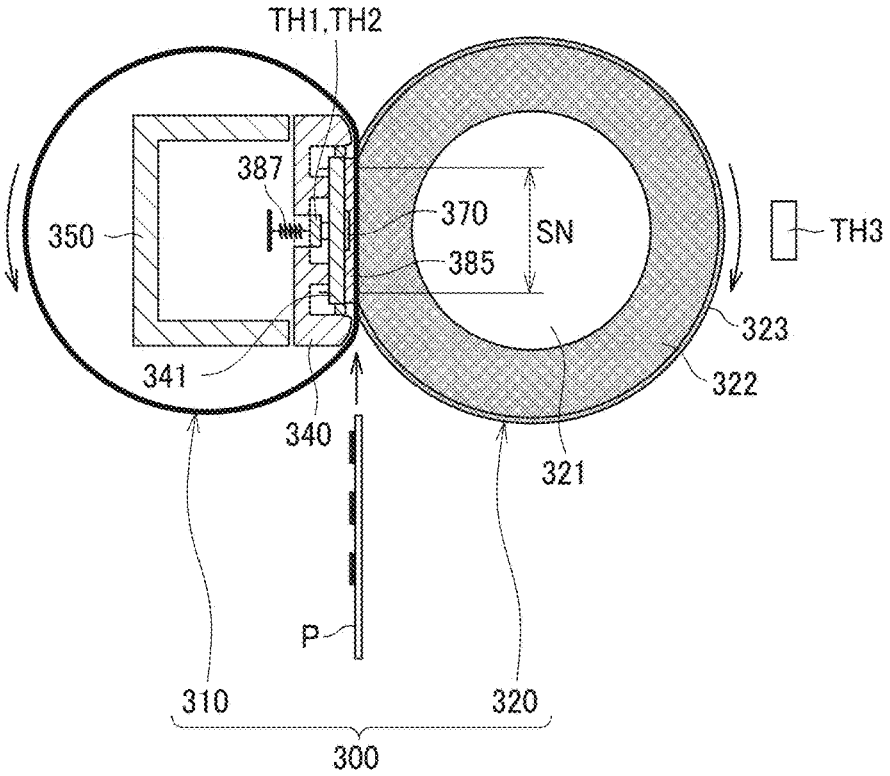
FIG. 2A is a cross-sectional view of a fixing device according to a first embodiment of the present disclosure.

As illustrated in FIG. 2A, the fixing device 300 according to a first embodiment of the present disclosure includes a thin fixing belt 310 having low thermal capacity and a pressure roller 320. The fixing belt 310 includes, for example, a tubular base made of polyimide (PI). The tubular base has an outer diameter of 25 mm and a thickness of from 40 micrometers (μm) to 120 μm.

The fixing belt 310 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness of from 5 μm to 50 μm to enhance durability of the fixing belt 310 and facilitate separation of the sheet P from the fixing belt 310. Optionally, an elastic layer that is made of rubber or the like and has a thickness in a range of from 50 μm to 500 μm may be interposed between the base and the release layer.

The base of the fixing belt 310 may be made of heat-resistant resin such as polyetheretherketone (PEEK) or metal such as nickel (Ni) or stainless steel (Stainless Used Steel. SUS), instead of polyimide. The inner circumferential surface of the fixing belt 310 may be coated with polyimide or polytetrafluoroethylene (PTFE) as a slide layer.

The pressure roller 320 having, for example, an outer diameter of 25 mm, includes a solid iron cored bar 321, an elastic layer 322 on the surface of the cored bar 321, and a release layer 323 formed on the outside of the elastic layer 322. The elastic layer 322 is made of silicone rubber and has a thickness of 3.5 mm, for example.

Preferably, the release layer 323 is formed by a fluororesin layer having, for example, a thickness of approximately 40 μm on the surface of the elastic layer 322 to enhance releasability. A biasing member presses the pressure roller 320 against the fixing belt 310.

A stay 350 and a heater holder 340 are disposed inside the fixing belt 310 and extend in the axial direction of the fixing belt 310. The stay 350 is made of a metal channel member, and both side plates of the fixing device 300 support both end portions of the stay 350. The stay 350 reliably receives the pressing force of the pressure roller 320 to stably form a fixing nip SN.

The heater holder 340 holds a base 341 of the fixing device 300 and is supported by the stay 350. Preferably, the heater holder 340 is made of heat-resistant resin having low thermal conduction, such as a liquid crystal polymer (LCP). Such a configuration can reduce heat transfer to the heater holder 340 and effectively heat the fixing belt 310.

The heater holder 340 has a shape that supports two portions of the base 341 near both end portions in a shorter-side direction of the base 341 to avoid contact with a high-temperature portion of the base 341. Thus, the amount of heat flowing to the heater holder 340 can be further reduced to effectively heat the fixing belt 310.

Figure 2B:
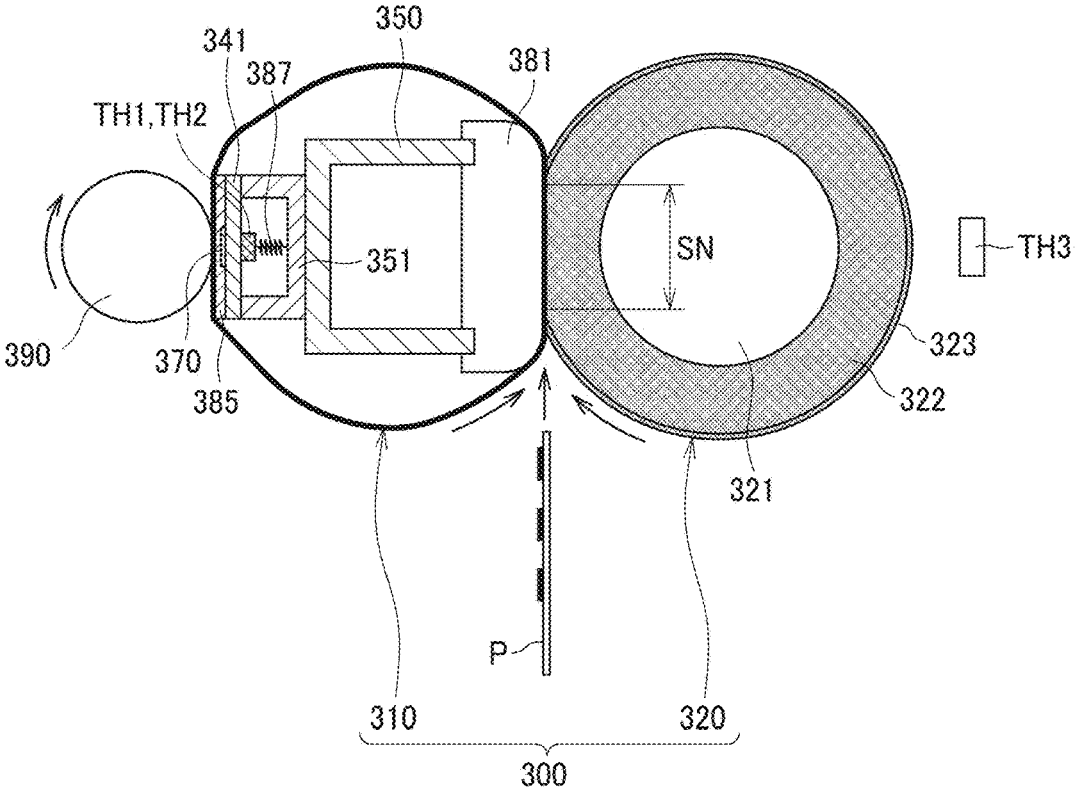
FIG. 2B is a cross-sectional view of a fixing device according to a second embodiment of the present disclosure.

The fixing device 300 can be of various types, and the fixing device illustrated in FIG. 2A is one example thereof. Hereinafter, the fixing devices 300 according to second to fourth embodiments of the present disclosure are described with reference to FIGS. 2B to 2D. As illustrated in FIG. 2B, the fixing device 300 according to the second embodiment includes a pressing roller 390 on the opposite side of the pressing roller 320, and nips the fixing belt 310 between the pressing roller 390 and the resistance member 370 to heat the fixing belt 310. The above-described heat generating member is disposed inside the fixing belt 310.

An auxiliary stay 351 attached on one side of a stay 350 and a nip formation pad 381 attached on the other side of the stay 350. The heat generating member is held by the auxiliary stay 351. The nip formation pad 381 contacts the pressure roller 320 via the fixing belt 310 to form a fixing nip SN.

Figure 2C:
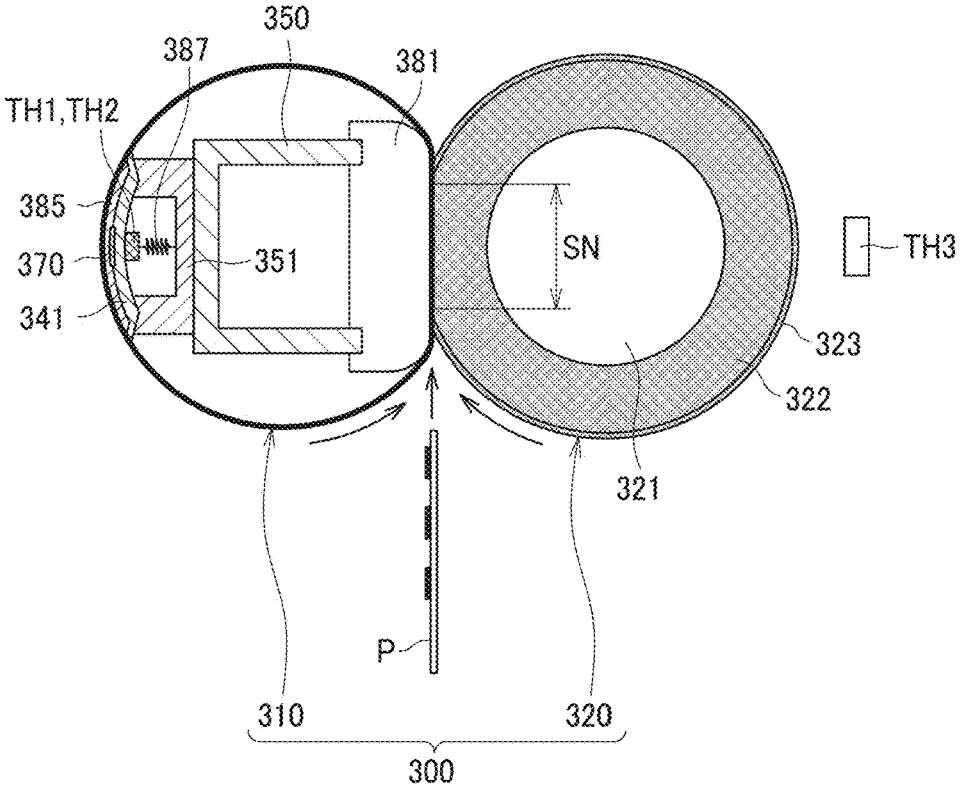
FIG. 2C is a cross-sectional view of a fixing device according to a third embodiment of the present disclosure.

In the fixing device 300 according to the third embodiment, as illustrated in FIG. 2C, a heat generating member is disposed inside a loop of the fixing belt 310. Instead of the pressing roller 390 described above, the heat generating member includes the base 341 and the insulating layer 385 both of which have arc-shaped cross sections meeting the curvature of the fixing belt 310 to increase the length of contact with the fixing belt 310 in the circumferential direction. The resistance member 370 is disposed at the center of the arc-shaped base 341. Other parts of the fixing device according to the third embodiment are the same as those of the fixing device according to the second embodiment in FIG. 2B.

Figure 2D:
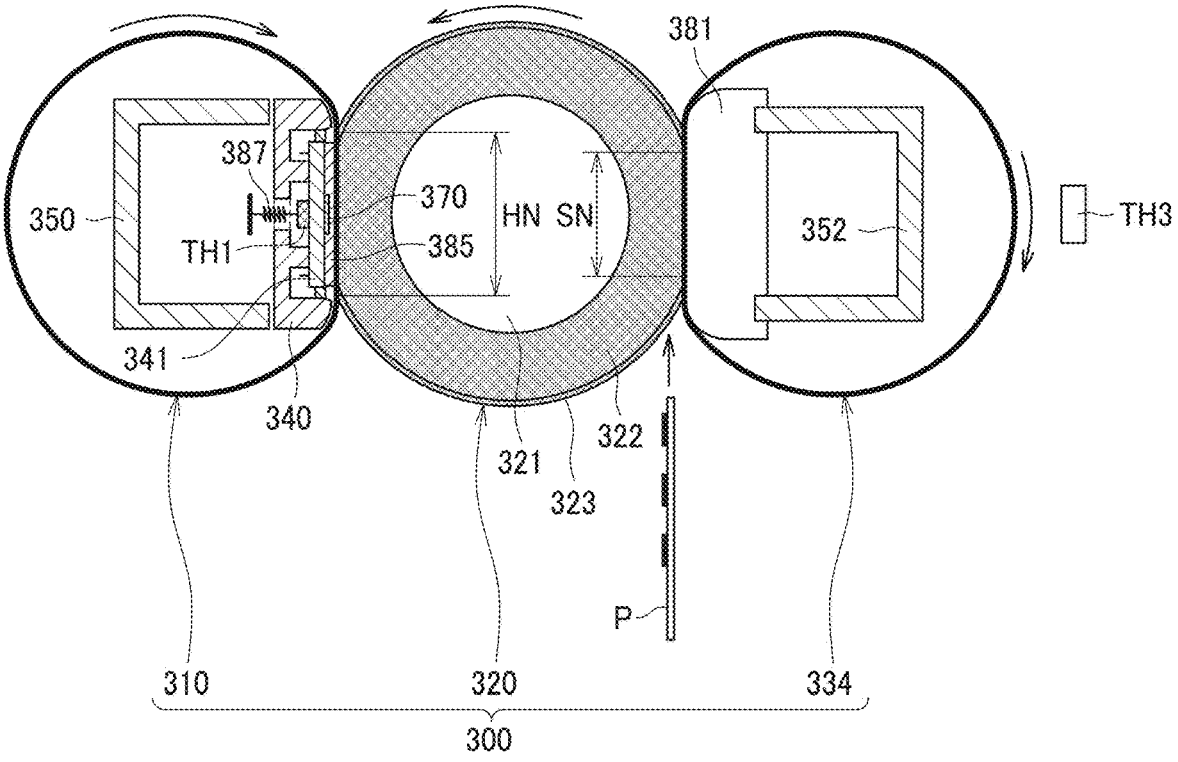
FIG. 2D is a cross-sectional view of a fixing device according to a fourth embodiment of the present disclosure.

As illustrated in FIG. 2D, the fixing device 300 according to the fourth embodiment includes a heating nip HN and the fixing nip SN separately. That is, the fixing belt 310 is disposed at one side of the pressure roller 320, and the nip formation pad 381 and the stay 352 made of a metallic channel member are disposed at the opposite side of the pressure roller 320 opposite to the one side at which the fixing belt 310 is disposed. A pressure belt 334 is disposed enclosing the nip formation pad 381 and the stay 352 so as to be circularly rotatable. The sheet P passes through the fixing nip SN between the pressure belt 334 and the pressure roller 320 and is subjected to heating and fixing. Other parts of the fixing device according to the fourth embodiment are the same as those of the fixing device according to the first embodiment illustrated in FIG. 2A.

The fixing device 300 as illustrated in FIG. 2A to FIG. 2D has the resistance member 370 including resistance heating elements such as planer heaters. The resistance member 370 can be formed in a plurality of types, such as the resistance member 330 illustrated as examples in FIG. 3C and FIG. 3D. In either type, the resistance members 370 and 330 are formed on the base 341. The base 341 is an elongated thin metal plate member coated with an insulating material. In the fixing method in which the fixing nip SN is heated by the planar heater, the resistance member serving as the heat generating member is divided into a plurality of parts in the width direction of the sheet and individually controlled to be heated, so that a plurality of types of sheet widths can be uniformly heated.

Low-cost aluminum or stainless steel is preferable as the material of the base 341. However, the material of the base 341 is not limited to metal and alternatively may be a ceramic, such as alumina or aluminum nitride, or a nonmetallic material having excellent thermal resistance and insulating properties, such as glass or mica.

To enhance thermal uniformity of the resistance members 330 and 370 and image quality, the base 341 may be made of a material having high thermal conductivity, such as copper, graphite, or graphene. The base 341 according to the present embodiment uses an aluminum base having a lateral (shorter-side) width of 8 mm, a longitudinal (longer-side) width of 270 mm, and a thickness of 1.0 mm.

Figure 3A:
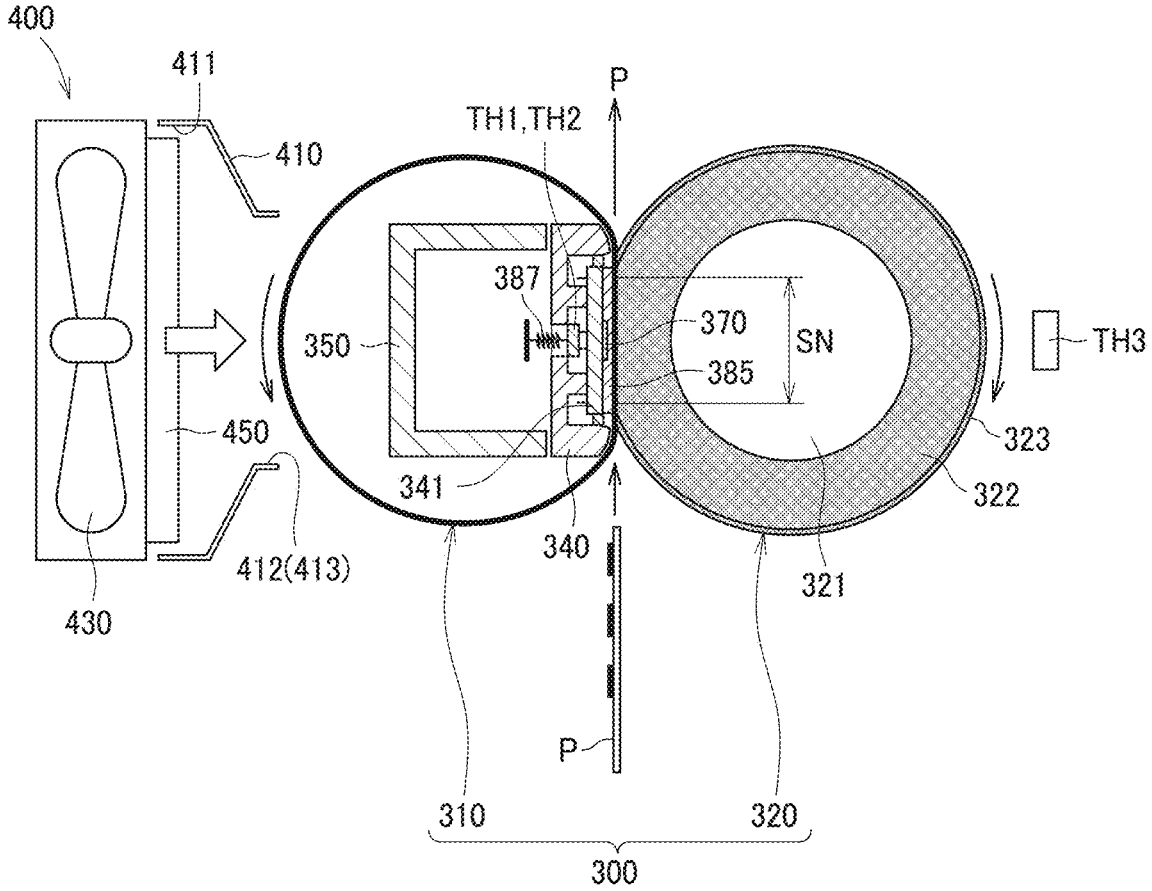
FIG. 3A is a cross-sectional view of a fixing device with a cooling device that blows air from a lateral side, according to an embodiment of the present disclosure.
Figure 3B:
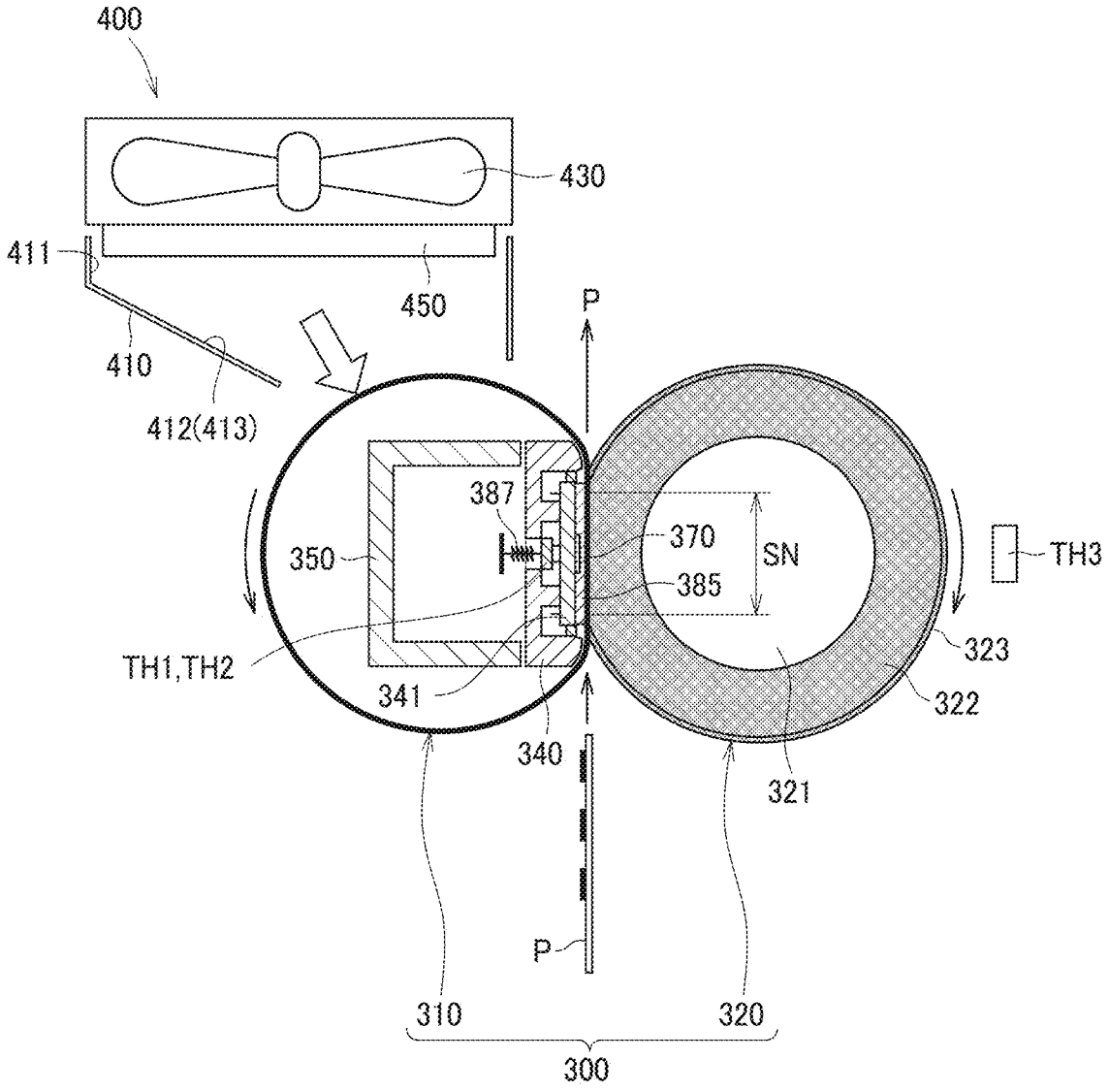
FIG. 3B is a cross-sectional view of a fixing device with a cooling device that blows air from above, according to an embodiment of the present disclosure.
Figure 3C:
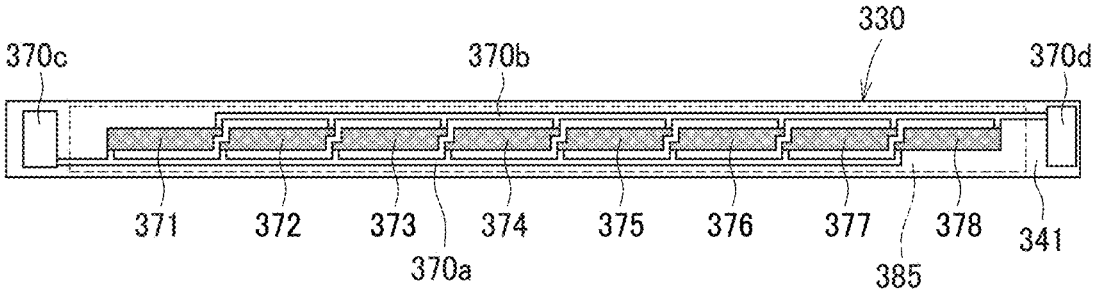
FIG. 3C is a plan view of a resistance member used in a fixing device according to an embodiment of the present disclosure.
Figure 3D:
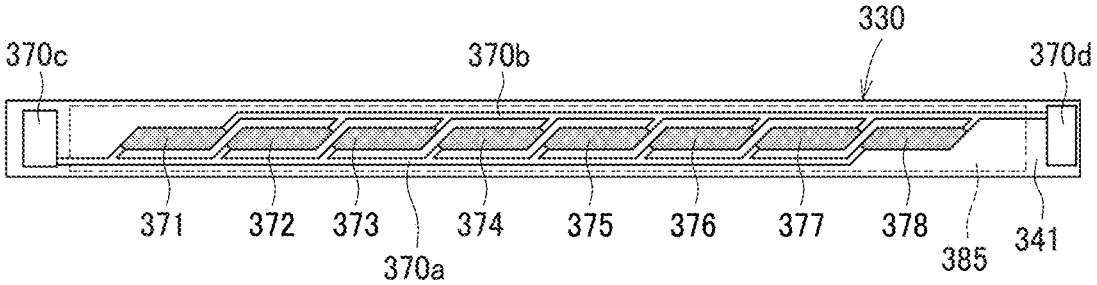
FIG. 3D is a plan view of a resistance member used in a fixing device according to an embodiment of the present disclosure.

The resistance member 330 in each of FIG. 3C and FIG. 3D can be configured as a multi-type in which positive temperature coefficient (PTC) elements 371 to 378 are electrically connected in parallel. When the resistance value between electrodes 370*c* and 370*d* at both ends of FIGS. 3C and 3D is assumed to be 10Ω, the resistance value of each of the PTC elements 371 to 378 is increased to 80Ω due to the parallel connection.

The PTC element is made of a material having a positive temperature resistance coefficient, and has a characteristic that the resistance value increases as the temperature T increases (the current I decreases and the heater output decreases). The temperature coefficient resistance (TCR) can be, for example, 1500 parts per million (PPM).

The PTC elements 371 to 378 illustrated in FIGS. 3C and 3D are arranged linearly at equal intervals in the longitudinal direction of the base 341. On both sides of each of the PTC elements 371 to 378 in the shorter direction, power supply lines 370*a* and 370*b* having small resistance values are linearly arranged in parallel to each other. Both ends of each of the PTC elements 371 to 378 are connected to the power supply lines 370*a* and 370*b*. Alternating current (AC) power is supplied to electrodes 370*c* and 370*d* formed at both end portions of each of the power supply lines 370*a* and 370*b*.

The PTC elements 371 to 378 and the power supply lines 370*a* and 370*b* are covered with a thin insulating layer 385. The insulating layer 385 may be, for example, a thermal resistance glass having a thickness of 75 μm. The insulating layer 385 insulates and protects the PTC elements 371 to 378 and the power supply lines 370*a* and 370*b* and maintains the slidability with the fixing belt 310.

The PTC elements 371 to 378 can be formed by, for example, applying a paste prepared by mixing silver-palladium (AgPd), glass powder, or the like to the base 341 by screen printing or the like, and then firing the base 341. In the present embodiment, the resistance value of each of the PTC elements 371 to 378 is set to 80Ω at normal temperature (the total resistance value is set to 10Ω).

As the material of the PTC elements 371 to 378, a resistance material such as a silver alloy (AgPt) or ruthenium oxide ($RuO_2$) may be used in addition to the materials described above. Silver (Ag), silver palladium (AgPd) or the like may be used as a material of the power supply lines 370*a* and 370*b* and the electrodes 370*c* and 370*d*. In such a case, screen-printing such a material forms the power supply lines 370*a* and 370*b* and the electrodes 370*c* and 367*d*.

The PTC elements 371 to 378 transfer heat to the fixing belt 310 that contacts the insulating layer 385, raise the temperature of the fixing belt 310, and heats an unfixed toner image on the sheet P conveyed to the fixing nip SN to fix the toner image on the sheet P. Use of the PTC elements 371 to 378 reduces an increase in temperature in the PTC element in which small sheets do not contact when the small sheets pass through the fixing device 300 since the relation of the resistance heating element between resistance and temperature reduces heat generation amount in the PTC element in which the small sheets do not contact.

For example, when printing is performed on sheets smaller than a width corresponding to all PTC elements 371 to 378, for example, sheets having a width smaller than the width corresponding to the PTC elements 373 to 376, temperatures in the PTC elements 371, 372, 377, and 378 disposed outside the sheets increase since the sheets do not absorb heat from the PTC elements 371, 372, 377, and 378. Raising temperatures in the PTC elements 371, 372, 377, and 378 causes increase in resistance values of the PTC elements 371, 372, 377, and 378.

Since a constant voltage is applied to the PTC elements 371 to 378, the increase in resistance values relatively reduces outputs of the PTC elements 371, 372, 377, and 378 disposed outside the width of the sheet, thus restraining an increase in temperature in end portions outside the sheets. If the PTC elements 371 to 378 are electrically connected in series, there is no method except a method of reducing a print speed to restrain temperature rises in resistance heating elements outside the width of the sheets during continuous printing. Electrically connecting the PTC elements 371 to 378 in parallel can restrain temperature rises in non-sheet passage portions while maintaining the print speed.

If there are gaps between the PTC elements 371 to 378 in the shorter direction, temperature decrease may occur in the gaps, which may cause uneven fixing. Hence, end portions of adjacent ones of the PTC elements 371 to 378 in the longitudinal direction overlap as illustrated in FIGS. 3C and 3D.

In FIG. 3C, a step portion formed by an L-shaped notch is formed an end portion of each of the PTC elements 371 to 378, and the step portion overlaps with a step portion at an end portion of an adjacent resistance heating element. In FIG. 3D, an oblique cut-away inclination is formed at each of the end portions of the PTC elements 371 to 378 so that the inclination overlaps the inclination of the end portion of the adjacent PTC element. Mutually overlapping the end portions of the PTC elements 371 to 378 in this manner can restrain the influence of a decrease in heat generating amount in gaps between the PTC elements.

The electrodes 370*c* and 370*d* may be disposed on one side of the PTC elements 371 to 378 instead of being disposed on both sides of the PTC elements 371 to 378. Disposing the electrodes 370*c* and 370*d* on one side of the PTC elements 371 to 378 in this manner reduces the size of the fixing device in the longitudinal direction, which results in space saving.

Each of the PTC elements 371 to 378 in FIGS. 3C and 3D is made of a strip-shaped planar heat generating element. In some embodiments, for example, a plurality of PTC elements having a meandering shape with a reduced line width may be electrically connected in parallel in order to obtain a desired output (resistance value).

Cooling Device

The cooling device 400 that cools, with air, both end portions of the fixing belt 310 of the fixing device 300 includes an air duct 410, a blower fan 430 as a blower, and a slide member 450 as illustrated in FIG. 3A. The air duct 410 extends in the longitudinal direction of the fixing belt 310, that is, in the direction perpendicular to the plane on which FIG. 3A is drawn. The slide member 450 constitutes an air-volume varying mechanism as described later. In the present specification, unless otherwise specified, the term "air volume" refers to the amount of gas flowing per unit time ($m^3$/second).

Figure 5A:
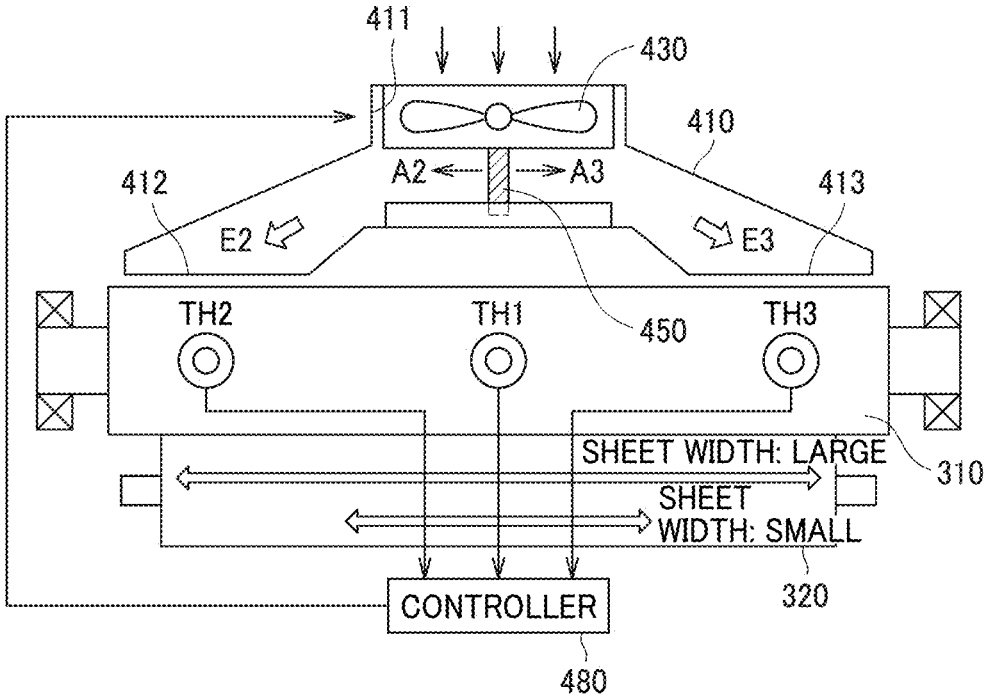
FIG. 5A is a cross-sectional view of a cooling device according to an embodiment of the present disclosure.

As illustrated in FIG. 5A, a first opening 411 having an air passage in the vertical direction is formed in a center portion of the air duct 410 in the longitudinal direction of the air duct 410. A second opening 412 and a third opening 413 are formed at both ends of the air duct 410 in the longitudinal direction. The position of the first opening 411 is not limited to just the center in the longitudinal direction of the air duct 410 and may be formed at a position (intermediate portion)

shifted to either the left or right from the center. In other words, the first opening 411 can be formed in an intermediate portion between the second opening 412 and the third opening 413.

Figure 5B:
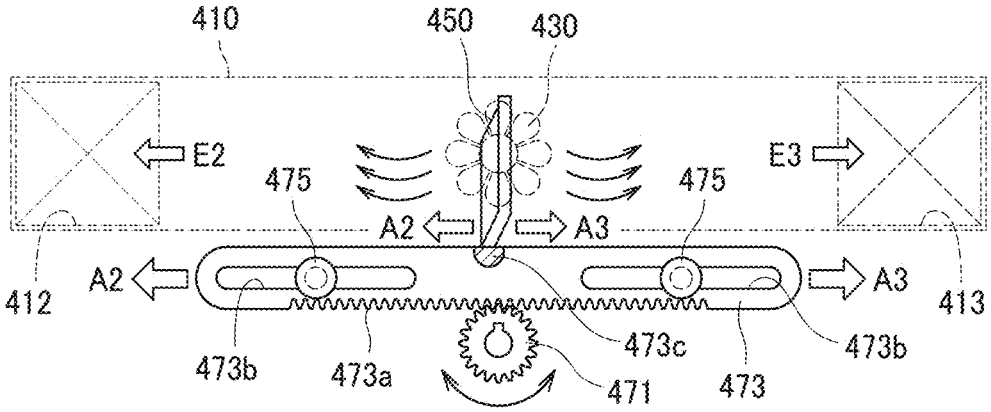
FIG. 5B is a plan 1 view of the cooling device of FIG. 5A.
Figure 5C:
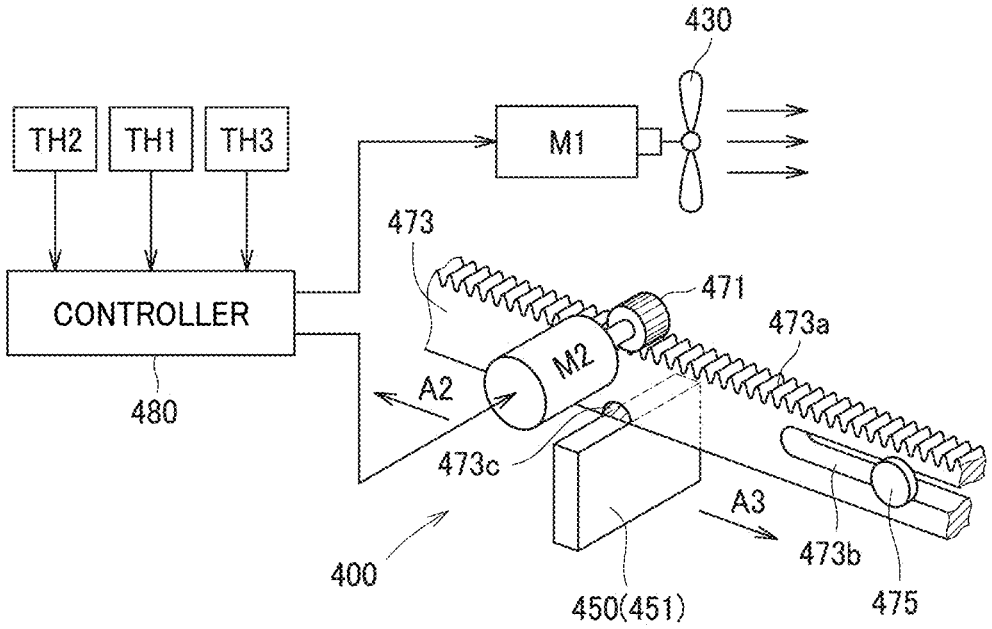
FIG. 5C is a configuration diagram of a controller that controls drive motors of the cooling device.

A blower fan 430 is disposed in the first opening 411. The blower fan 430 is driven by a drive motor M1 as illustrated in FIG. 5C. Disposing the blower fan 430 in the first opening 411 allows space saving and reduction of the number of components.

The blower fan 430 may be disposed outside the first opening 411. In such a case, the blower fan 430 and the first opening 411 are connected by a blower duct. Although the blower fan 430 illustrated in FIG. 5A is a propeller-type, the blower fan 430 is not limited thereto and various blower fans such as a sirocco fan, a turbo fan, an airfoil fan, and a plate fan can be used.

A slide member 450 having a partition shape is disposed immediately downstream of the blower fan 430 at right angles to the longitudinal direction of the air duct 410. The air introduced into the first opening 411 by the blower fan 430 is distributed to the left and right at a predetermined ratio by the slide member 450, and is blown out toward both end portions of the fixing belt 310 from the second opening 412 and the third opening 413.

As described above, disposing one blower fan 430 at the center portion in the longitudinal direction of the air duct 410 allows significant space saving and a reduction in the number of components compared to a case in which a plurality of blower fans are disposed as in the related art. In addition, an excessive temperature rise in the end portions of the fixing belt 310 having a small heat capacity can be effectively restrained according to the temperature rise.

Figure 4A:
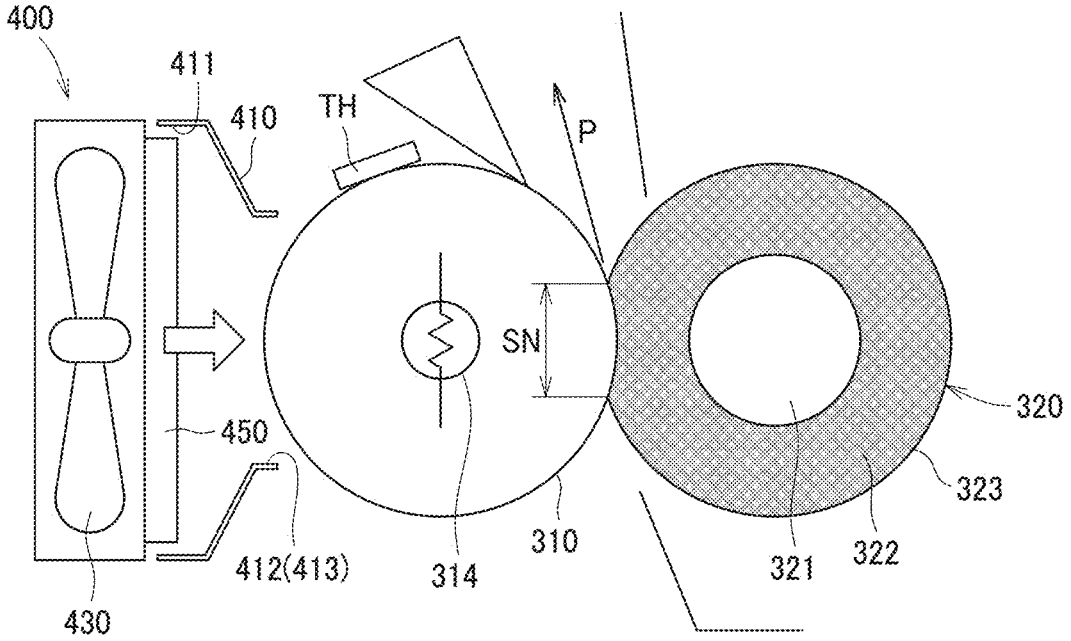
FIG. 4A is a cross-sectional view of a fixing device with a cooling device that blows air from a lateral side, according to an embodiment of the present disclosure.
Figure 4B:
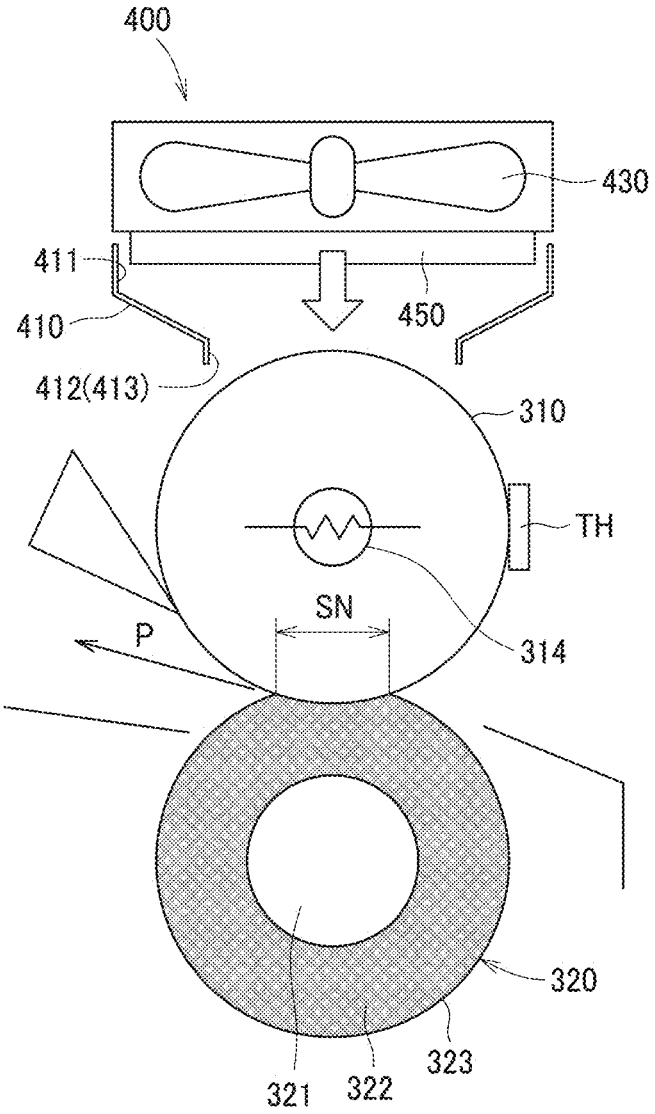
FIG. 4B is a cross-sectional view of a fixing device with a cooling device that blows air from above, according to an embodiment of the present disclosure.

The cooling air can be blown from the second opening 412 and the third opening 413 in a horizontal lateral direction of the fixing belt 310 as illustrated in FIG. 3A or in the downward direction from above the fixing belt 310 as illustrated in FIG. 3B. Disposing the second opening 412 and the third opening 413 allows cooling air to be effectively supplied to a portion of the fixing belt 310 to be cooled. Further, as a heating source, a halogen heater 314 can be disposed inside the fixing belt 310 as illustrated in FIGS. 3A and 3B instead of the planar heater using the resistance member 370 as illustrated in FIGS. 4A and 4B. In FIG. 4A, cooling air is blown from the horizontal lateral direction of the fixing belt 310 as in FIG. 3A. In FIG. 4B, cooling air is blown downward from above the fixing belt 310 as in FIG. 3B.

Details of Cooling Device

Next, the cooling device according to an embodiment of the present disclosure is described in further detail with reference to FIGS. 5A to 5C. The air duct 410 extends in the longitudinal direction of the fixing belt 310 as illustrated in FIG. 5A. FIG. 5B is a plan view of the air duct 410 viewed from above. In this plan view, the air duct 410 has a rectangular shape that is long in the longitudinal direction of the fixing belt 310.

The second opening 412 at the left end and the third opening 413 at the right end of the air duct 410 have substantially square shapes having the same size in the plan view of FIG. 5B and are open toward the outer peripheral surfaces of both end portions of the fixing belt 310. A gap between the outer peripheral surface of each end portion of the fixing belt 310 and each of the second opening 412 and the third opening 413 are set to have a size that does not hamper the rotation of the fixing belt 310. If the gap is larger than necessary, air would flow out wastefully and the cooling effect would decrease. Therefore, the size of the gap is, for example, preferably about 2 mm to 3 mm at most.

The second opening 412 and the third opening 413 preferably have a shape that covers the outer peripheral surfaces of both end portions of the fixing belt 310 in an arc shape. Accordingly, the gap between the outer peripheral surface of each end portion of the fixing belt 310 and each of the second opening 412 and the third opening 413 can be maintained constant in the circumferential direction, thus enhancing the cooling effect.

The central portion of the air duct 410 in the longitudinal direction is spaced upward from the outer circumference of the fixing belt 310 in the side view of FIG. 5A and has a shape bent in an inverted V shape at an obtuse angle as a whole. With this shape, the cooling air supplied to the first opening 411 at the center portion in the longitudinal direction smoothly flows to the second opening 412 and the third opening 413 in the directions indicated by arrows E2 and E3 and is effectively blown to both end portions of the fixing belt 310.

The slide member 450 is disposed on the bottom surface of the central portion of the air duct 410 in the longitudinal direction of the air duct 410 at right angles to the longitudinal direction of the air duct 410. The slide member 450 is disposed so as to be slidable in the longitudinal direction of the air duct 410, in other words, in the left-right direction in FIG. 5A by a rack and pinion mechanism of FIG. 5B. The rack and pinion mechanism includes a pinion gear 471 that is rotationally driven by a drive motor M2 and a rack 473 that meshes with the pinion gear 471.

The rack 473 extends in the longitudinal direction of the air duct 410, and the pinion gear 471 meshes with rack teeth 473*a* formed on the lower edge of the rack 473. Elongated holes 473*b* extending in the left-right direction are formed at two left and right positions of the rack 473, and guide pins 475 extending from the fixed side are slidably inserted into the elongated holes 473*b*.

The central portion of the rack 473 in the longitudinal direction of the rack 473 is connected to a lateral side of the slide member 450 via the fixing member 473*c*. When the pinion gear 471 rotates to the left in FIG. 5B, the rack 473 and the slide member 450 slide in the direction indicated by arrow A2 (left direction). When the pinion gear 471 rotates to the right, the rack 473 and the slide member 450 slide in the direction indicated by arrow A3 (right direction). Since the slide member 450 can be moved only by the rotation operation of the pinion gear 471 of the rack and pinion mechanism, cooling for eliminating a temperature difference between both end portions of the fixing belt 310 can be performed with a simple mechanism.

Thermistors TH1 to TH3 as temperature detectors that detect the temperature of the fixing belt 310 are disposed in proximity to the outer peripheral surface of the fixing belt 310. The thermistor TH1 is disposed in proximity to the outer peripheral surface of the fixing belt 310 at the center portion in the longitudinal direction of the fixing belt 310. The thermistor TH1 is positioned at the center of the small sheet width of the small-size sheet. The thermistors TH2 and TH3 are disposed in proximity to the outer peripheral surfaces of both end portions of the fixing belt 310, and the thermistors TH2 and TH3 are positioned at end portions of the large sheet width of the large-size sheet.

The temperatures detected by the thermistors TH1 to TH3 are input to the controller 480 illustrated in FIG. 5C. The controller 480 control driving of the drive motor M1 for the blower fan 430 and the drive motor M2 for the slide member 450, based on the temperature information of the fixing belt 310 obtained from the thermistors TH1 to TH3. Therefore, the controller 480 constitutes part of the cooling device 400.

Figure 6A:
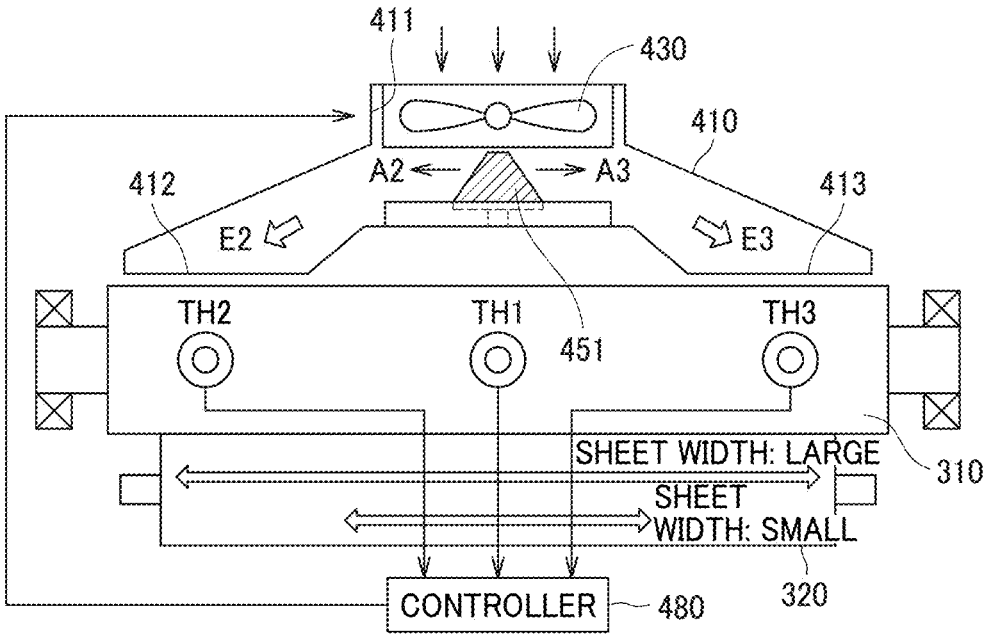
FIGS. 6A and 6B are cross-sectional views of a slide member of a cooling device according to a modified embodiment of the present disclosure.
Figure 6B:
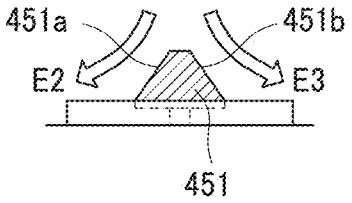

As illustrated in FIGS. 6A and 6B, the slide member 450 is preferably a wedge-shaped slide member 451 having inclined surfaces 451*a* and 451*b* on the left and right sides. With the inclined surfaces 451*a* and 451*b* on the left and right sides of the slide member 451, the air vertically introduced into the first opening 411 by the blower fan 430 is smoothly guided horizontally by the inclined surfaces 451*a* and 451*b* as illustrated in FIG. 6B. Accordingly, air resistance in the slide member 451 is reduced, and a sufficient amount of air can be stably supplied to the second opening 412 and the third opening 413.

Figure 7A:
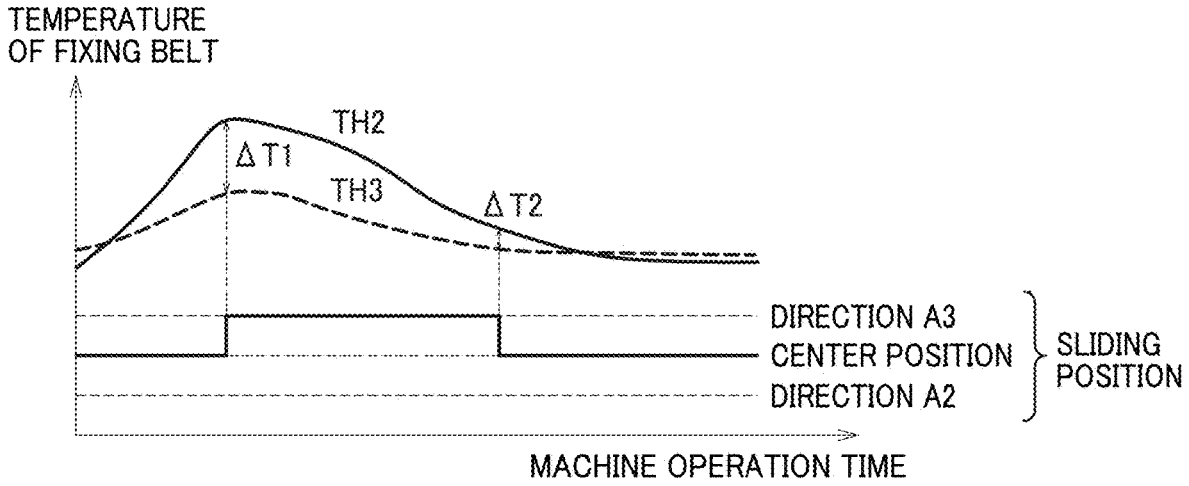
FIG. 7A is a graph illustrating the temperature of a fixing belt and an operation of the slide member.

FIG. 7A illustrates a state in which the sliding movement of the slide member 450 (451) is controlled by the controller 480 when the temperature rise (vertical axis) of both end portions of the fixing belt 310 detected by the thermistors TH2 and TH3 occurs with the elapse of the machine operation time (horizontal axis) during continuous passage of the small-size sheets. In the example illustrated in FIG. 7A, the temperature rise is steeper in the thermistor TH2 at the left end (solid line) than in the thermistor TH3 at the right end (broken line). Accordingly, the difference ΔT between the temperatures detected by the thermistors TH2 and TH3 increases to ΔT1.

With the temperature difference ΔT1 as a threshold value, the slide member 450 (451) slides by a certain amount from the central position toward the direction indicated by arrow A3 in FIG. 5B. By the movement of the slide member 450 (451), the amount of air blown out from the third opening 413 on the moving side decreases, whereas the amount of air blown out from the second opening 412 on the opposite side to the moving side increases. Accordingly, the cooling effect of the left end portion of the fixing belt 310 increases, and the temperature difference decreases from ΔT1 to ΔT2. Then, with the temperature difference ΔT2 as a threshold value, the slide member 450 (451) returns from the position slid in the A3 direction to the center position.

As described above, the amount of air supplied to the first opening 411 by the single blower fan 430 is distributed to the left and right by the slidable slide member 450 (451) and blown out from the second opening 412 and the third opening 413. Thus, the cooling device can have a much simpler configuration than a conventional cooling device having separate left and right blower fans. In addition, when the temperatures of both end portions of the fixing belt 310 are different from each other, the slide member 450 (451) is slid to cool both end portions so as to reduce the temperature deviation of both end portions. Thus, a fixing device capable of achieving high image quality can be provided at low cost and in a small space.

Figure 7B:
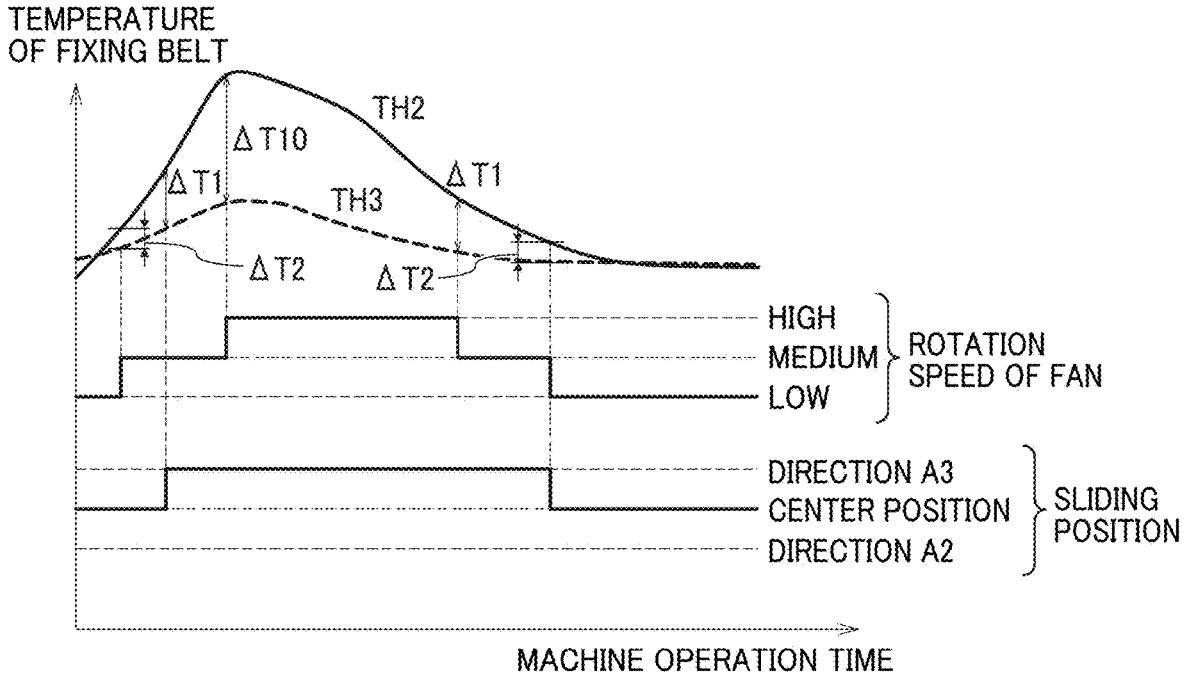
FIG. 7B is a graph illustrating temperature of the fixing belt and operations of a blower fan and the slide member.

FIG. 7B illustrates an example in which the rotational speed of the blower fan 430 is controlled to be switched in three stages in addition to the above-described slide movement control of the slide member 450 (451). That is, the controller 480 controls the driving of the slide member 450 (451) and the blower fan 430 based on the temperature change (vertical axis) between both end portions of the fixing belt 310 detected by the thermistors TH2 and TH3 with the elapse of the machine operation time (horizontal axis). In the example illustrated in FIG. 7B, the difference ΔT between the temperatures detected by the thermistors TH2 and TH3 increases as ΔT2→ΔT1→ΔT10 (ΔT2<ΔT1<ΔT10).

The rotation speed of the blower fan 430 is low until the temperature difference ΔT reaches ΔT2, and increases to medium when the temperature difference ΔT exceeds ΔT2. Accordingly, the amount of air blown out from the second opening 412 and the third opening 413 increases, and the cooling effect of lowering the temperatures of both end portions of the fixing belt 310 increases.

When the temperature difference ΔT exceeds ΔT2 and reaches ΔT1, the rotation speed of the blower fan 430 remains at the medium rotation speed and the slide member 450 slides in the A3 direction by a predetermined distance. By this sliding movement, the air supply amount in the A3 direction decreases, while the air supply amount in the A2 direction, by which the temperature rapidly rises, increases.

When the temperature difference ΔT exceeds ΔT1 and reaches ΔT10, the rotation speed of the blower fan 430 increases from the medium rotation speed to the high rotation speed while the slide member 450 remains at the position shifted in the A3 direction. Accordingly, the amount of air blown out from the second opening 412 and the third opening 413 increases, and the cooling effect of lowering the temperatures of both end portions of the fixing belt 310 increases. At this time, since the slide member 450 is at the position shifted in the A3 direction, the cooling effect by the air blowing from the second opening 412 is greater than the cooling effect by the air blowing from the third opening 413.

Accordingly, a sharp rise in the temperature of the left end of the fixing belt 310 is restrained with the temperature difference ΔT10 as a peak, and the temperature gradually decreases. When the temperature difference returns to ΔT1, first, the rotation speed of the blower fan 430 decreases from high rotation speed to medium rotation speed. When the temperature difference further decreases to ΔT2, the rotation speed of the blower fan 430 decreases from the medium rotation speed to low rotation speed. At the same time, the slide member 450 returns from the position shifted in the A3 direction to the center position. Accordingly, the amounts of air blown out from the second opening 412 and the third opening 413 are equal to each other in a low air volume.

As described above, the change of the air blowing amounts of the second opening 412 and the third opening 413 can be performed by changing the position of the slide member 450 as the air-amount varying mechanism or changing the rotation speed of the blower fan 430 based on the temperature difference between the thermistors TH2 and TH3. Such a configuration does not increase the air volume of the blower fan 430 at all times, but increases the air volume only for a necessary time at a necessary time, thus allowing an energy saving effect to be obtained. In the above description, the rotation speed of the blower fan 430 is controlled based on the temperature difference between the thermistors TH2 and TH3 at both ends. However, the rotation speed may be controlled based on the temperature difference between the thermistor TH1 at the center and one of the thermistors TH2 and TH3 at both ends.

Figure 8:
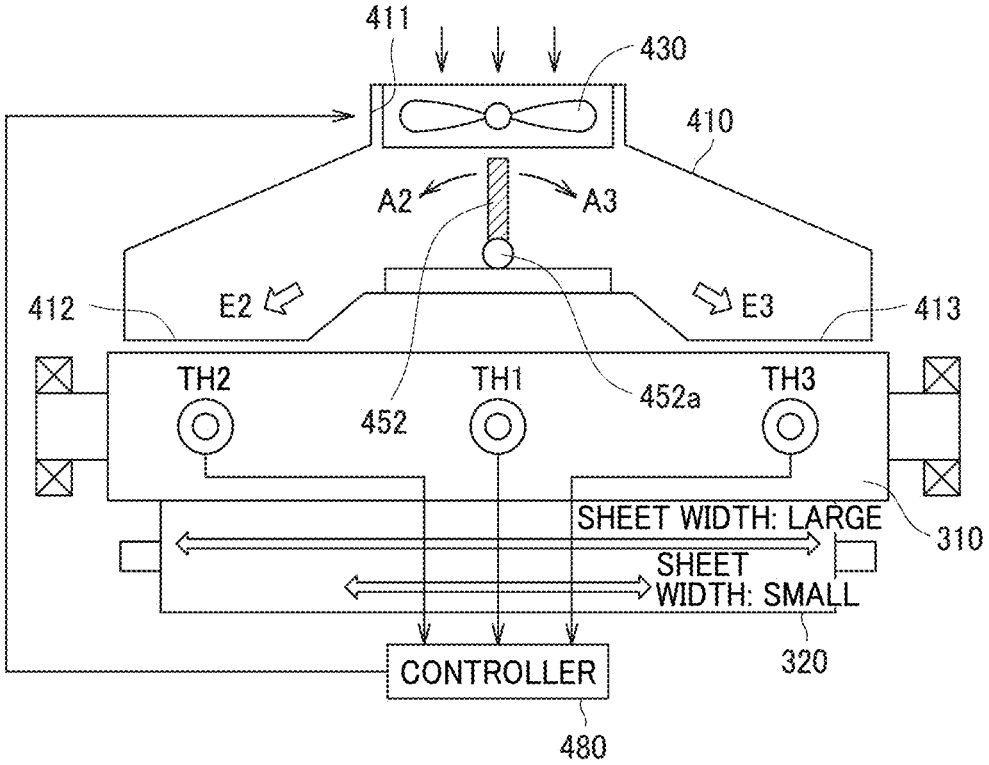
FIG. 8 is a cross-sectional view of an air-volume varying mechanism according to a variation of the present disclosure.

The air-volume varying mechanism using the slide member 450 (451) described above can be replaced with another modified embodiment. FIG. 8 illustrates one of such modified embodiments, and in this modified embodiment, an air-volume varying includes a swing member 452 that can swing about a rotation fulcrum 452*a*.

The rotation fulcrum 452*a* can be rotated clockwise and counterclockwise in FIG. 8 by a motor or a cam, and this rotation causes the swing member 452 to rotate in the direction indicated by arrow A2 or A3. The rotation of the swing member 452 can change the air volume distribution ratio, similarly to the above-described sliding movement of the slide member 451.

Figure 9:
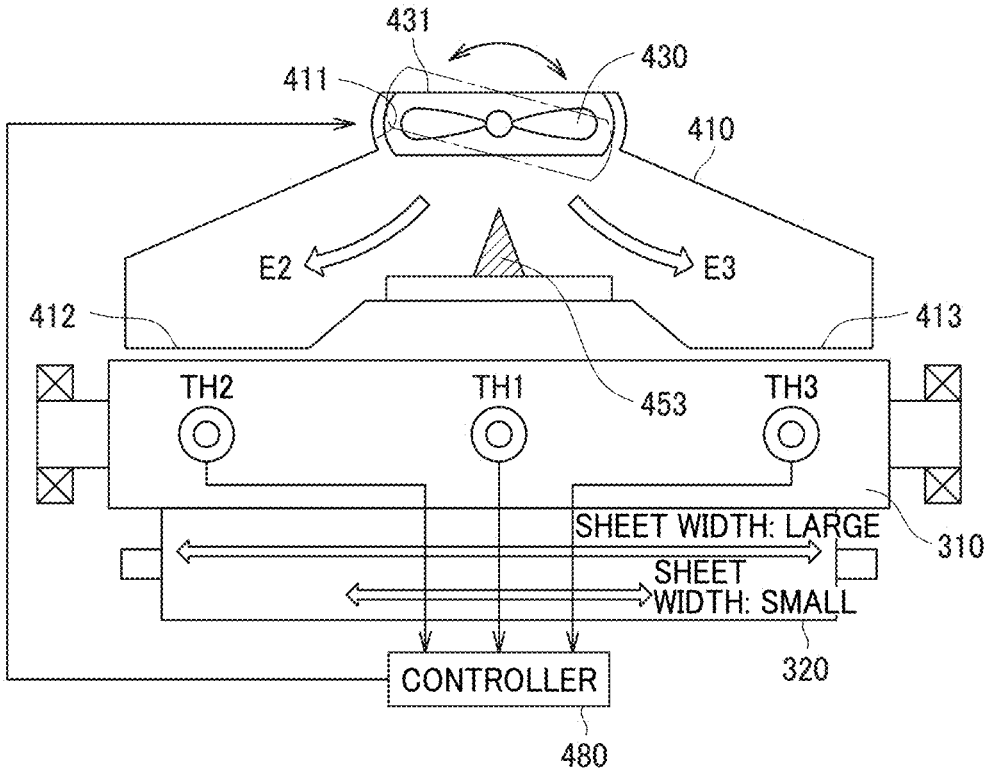
FIG. 9 is a cross-sectional view of an air-volume varying mechanism according to a variation of the present disclosure.

FIG. 9 illustrates a modified embodiment of an air-volume varying mechanism in which a fixed partition member 453 that does not slide and a swingable blower fan 430 are combined. The partition member 453 can be formed in a wedge shape having a triangular cross section, and the tip of the wedge shape extends at right angles to the longitudinal direction of the air duct 410 in a state of being directed to the center of the first opening 411.

The blower fan 430 is attached to a holder 431 capable of swinging in the left-right direction in FIG. 9. When the holder 431 is inclined to the right side as illustrated in FIG. 9 by a swing mechanism using a motor or a cam, the amount of air distributed to the left side increases and the amount of air supplied to the opposite side decreases. As described above, even when the fixed partition member 452 is used, the amount of air distributed to the second opening 512 and the third opening 513 can be changed by swinging the blower fan 430.

Figure 10A:
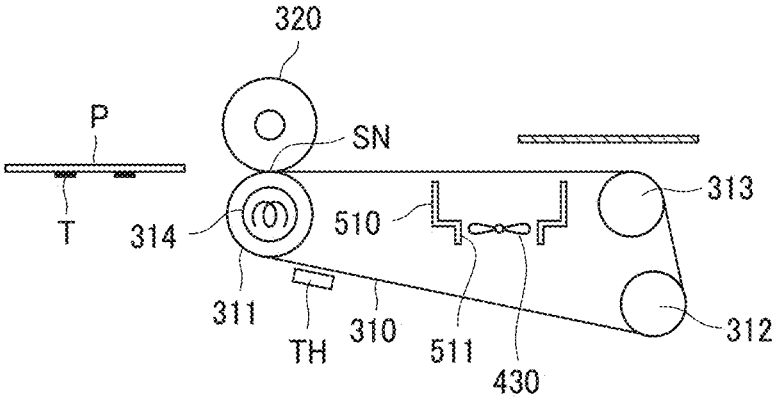
FIGS. 10A and 10B are cross-sectional views of a fixing device with a cooling device according to a variation of the present disclosure.
Figure 10B:
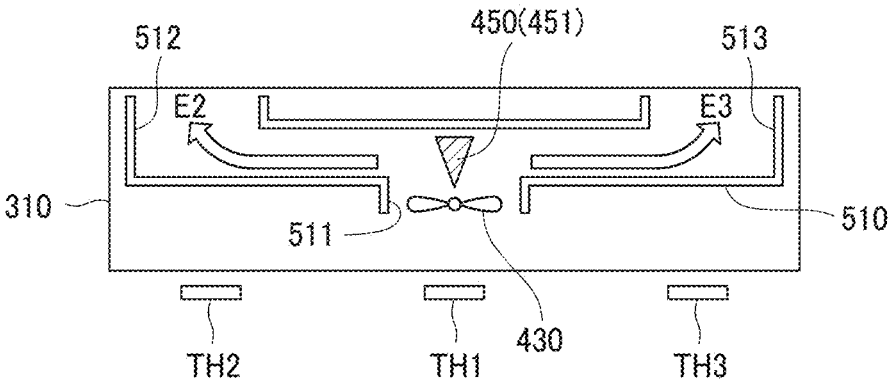

In addition, the configuration of the fixing device 300 according to an embodiment of the present disclosure is not limited to the examples illustrated in FIGS. 2A to 2D. For example, a configuration may be adopted in which the fixing belt 310 is wound around three rollers 311 to 313 as illustrated in FIGS. 10A and 10B. In other words, the fixing device illustrated in FIGS. 10A and 10B includes a fixing belt 310, a heating roller 311, guide rollers 312 and 313, and a pressure roller 320.

The fixing belt 310 is wound around the heating roller 311 and the guide rollers 312 and 313 and circulates around these rollers 311 to 313 in the clockwise direction in FIG. 10A. The fixing belt 310 may be entrained and rotated clockwise by driving the pressing roller 320 to rotate counterclockwise, or the fixing belt 310 may be rotated clockwise by driving the heating roller 311 or one of the guide rollers 312 and 313 to rotate clockwise.

The air duct 510 is disposed inside the fixing belt 310. As illustrated in FIG. 10B, the blower fan 430 is disposed at the first opening 511 at the center in the longitudinal direction of the air duct 510. The lower surface of the fixing belt 310 between the heating roller 311 and the guide roller 313 is cooled by air blown out from the second opening 512 and the third opening 513 formed at both ends of the air duct 510.

A slide member 450 (451) slidably disposed inside the first opening 511 is slid and moved in the longitudinal direction of the air duct 510 to change the air volume ratio of air blown from the second opening 512 and the third opening 513.

The temperatures of the center portion and both end portions of the fixing belt 310 are detected by thermistors TH1 to TH3 arranged at three places in the longitudinal direction of the outer periphery of the fixing belt 310. Based on the detected temperature, the slide member 450 (451) is slid as described above so that the temperature difference between both ends of the fixing belt 310 does not exceed the predetermined threshold value.

Although some embodiments of the present disclosure have been described above, embodiments of the present disclosure are not limited to the embodiments described above, and a variety of modifications can be made within the scope of the present disclosure. For example, the air-volume varying mechanism can be a combination of the slide members 450 and 451 and the swing member 452. In such a configuration, for example, the slide members 450 and 451 in FIG. 5A and FIG. 6 is swingable in the left-right direction as illustrated in FIG. 8. Alternatively, the swing mechanism of FIG. 9 that swings the blower fan 430 in the longitudinal direction of the air duct 510 may be combined with the slide members 450 and 451 of FIG. 5A and FIG. 6 or the swing member 452 of FIG. 8. The cooling device according to an embodiment of the present disclosure can also be used for applications other than fixing devices, such as cooling of heating members used in drying devices. In addition to the resistance member 370 and the halogen heater 314, any other type of heat generating element such as a ceramic heater can be used as the heat generating element that heats the fixing belt 310.

The present disclosure is not limited to specific embodiments described above, and numerous additional modifications and variations are possible in light of the teachings within the technical scope of the present disclosure. It is therefore to be understood that the disclosure of the present specification may be practiced otherwise by those skilled in the art than as specifically described herein. Such modifications and alternatives are within the technical scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A cooling device configured to cool, with air, a heating member having a longitudinal direction, the cooling device comprising:

a blower configured to blow the air;

an air duct through which the air passes, the air duct having a first opening to which the air is supplied by the blower, a second opening configured to face a portion of the heating member, and a third opening configured to face another portion of the heating member, the second opening being spaced from the third opening in the longitudinal direction of the heating member; and an air-volume varying mechanism configured to change an air volume of the air discharged from the second opening and the third opening, wherein the air-volume varying mechanism includes a slide member in the air duct on a downstream side of the first opening in a direction in which the blower is configured to blow the air and the slide member being configured to move in its entirety in the longitudinal direction of the heating member within the air duct in order to vary an amount of air directed to the second opening and the third opening.

2. The cooling device according to claim 1, further comprising a rack and a pinion gear configured to move the slide member in the longitudinal direction of the air duct.

3. The cooling device according to claim 1, wherein the slide member has an inclined surface configured to guide the air supplied from the blower in the longitudinal direction of the air duct.

4. The cooling device according to claim 1, further comprising a temperature detector configured to detect temperatures of both end portions of the heating member in the longitudinal direction of the heating member, wherein the air-volume varying mechanism is configured to operate to increase a ratio of an air volume distributed to an end portion having a higher temperature of both end portions of the heating member in the longitudinal direction of the heating member, based on the temperatures detected by the temperature detector.

5. An image forming apparatus, comprising the cooling device according to claim 1.

6. The cooling device according to claim 1, further comprising a temperature detector configured to detect temperatures of the heating member, wherein the air-volume varying mechanism is configured to vary an air blowing amount of the blower according to the temperatures detected by the temperature detector.

7. The cooling device according to claim 6, further comprising a plurality of temperature detectors, including the temperature detector, configured to detect temperatures of both end portions in the longitudinal direction of the heating member.

8. A fixing device comprising the heating member configured to heat and fix a toner image borne on a sheet, wherein the heating member is configured to be cooled by the cooling device according to claim 1.

9. An image forming apparatus, comprising the fixing device according to claim 8.

10. A cooling device configured to cool, with air, a heating member having a longitudinal direction, the cooling device comprising:

a blower configured to blow the air;

an air duct through which the air passes, the air duct having a first opening to which the air is supplied by the blower, a second opening configured to face a portion of the heating member, and a third opening configured to face another portion of the heating member; and an air-volume varying mechanism configured to change an air volume of the air discharged from the second opening and the third opening;

wherein the air-volume varying mechanism includes a swing mechanism configured to swing the blower in a longitudinal direction of the air duct.

11. The cooling device according to claim 10, wherein the swing mechanism is configured to swing the blower around an axis of rotation.

* * * * *